US005402920A

United States Patent [19]

Dhillon

[11] Patent Number: 5,402,920

[45] Date of Patent: Apr. 4, 1995

[54] NO SPILL CONTAINER

[76] Inventor: Sunny S. Dhillon, 1005 Brentwood La., Wheaton, Ill. 60187

[21] Appl. No.: 98,720

[22] Filed: Jul. 29, 1993

[51] Int. Cl.[6] ..... B67D 3/00

[52] U.S. Cl. ..... 222/519; 222/552; 141/351; 141/362; 141/364

[58] Field of Search ..... 222/185, 162, 171, 83, 222/91, 519, 521, 554, 88, 552; 141/351, 353, 354, 360, 362-364

[56] References Cited

U.S. PATENT DOCUMENTS

| | | | |
|---|---|---|---|
| 915,742 | 3/1909 | Comings | 222/519 |
| 2,618,800 | 11/1952 | Raab | 222/519 |
| 3,285,453 | 11/1966 | Wagner | 222/521 |
| 4,846,380 | 7/1989 | Giuseppe | 222/519 |
| 5,139,182 | 8/1992 | Appla | 222/519 |
| 5,146,957 | 9/1992 | Belokin, Jr. et al. | 141/364 |

FOREIGN PATENT DOCUMENTS

| | | | |
|---|---|---|---|
| 616328 | 1/1927 | France | 222/88 |
| 3514132 | 10/1986 | Germany | 222/519 |

*Primary Examiner*—Andres Kashnikow
*Assistant Examiner*—Philippe Derakshani
*Attorney, Agent, or Firm*—Jerome Goldberg

[57] ABSTRACT

A no spill container including a bottle having a threaded neck for attaching to a threaded cap. The cap includes a conical stopper and a flared skirt extending inward on the bottle. The inward end or hem of the skirt provides a gripping surface away from the neck of the bottle for opening and closing the cap. The neck includes an opening to receive the stopper when the cap is closed. An aperture is formed in the cap. When the cap is open, fluid in the container flows into the neck opening and is discharged from the aperture. When the cap is closed the stopper extends inside the neck opening and the outer end of the neck closes the aperture in the cap, to thereby prevent fluid flow out from the container.

6 Claims, 2 Drawing Sheets

NO SPILL CONTAINER

BACKGROUND OF THE INVENTION

This invention relates generally to a container for fluids; and more particularly relates to a container including a cap and bottle which is opened or closed by manipulating the cap and bottle at locations spaced from the fluid discharge end of the bottle.

In the past, containers for storing fluids, such as oils and lubricants, had a can or cylindrical configuration, usually made from metal. More recently, the oil containers have been constructed with an outer nozzle, and made from a plastic material. After these prior containers were opened usually some spilling occurred upon initially pouring the fluid into a receiving opening. The spilling of the contents would also occur if the container was pulled away from the receiving opening prior to the container being fully emptied. This spilling often presented a hazardous condition due to the combustible nature of the contents of the container.

To avoid such spillage of the container, a wide diameter conical funnel was frequently positioned in the receiving opening and the contents of the container poured into the funnel. However, these funnels would often get lost or misplaced or were not readily available when needed.

The subject invention overcomes the spillage problem by enabling the upper end of the closed container to be positioned in the fluid receiving opening and thereafter opening the container for discharging the contents. Moreover, if less than the entire contents were needed, the container could be closed prior to removing same from the fluid receiving opening.

SUMMARY OF THE INVENTION

A no spill container is provided which enables the container to be opened and closed after being positioned in a fluid receiving opening or in an upside down position. The container includes a bottle and a cap extending inward from the outer end of the bottle, to provide a gripping position spaced from the outer end of the bottle. To open the container, one hand is used to grip the inner end of the cap and the other hand is used to twist or rotate the bottom end of the container in an open direction; and conversely, to close the container, one hand is used to grip the inner end of the cap and the other hand is used to twist or rotate the bottom end of the container in the opposite or closed direction.

The cap includes a stopper for extending inside the neck of the bottle and an outlet aperture for discharging the fluid. When the cap is closed, the stopper is positioned inside the neck of the bottle and the aperture is closed by the outer end of the neck of the bottle. When the cap is opened, the stopper is pulled outward from the neck of the bottle and the outlet aperture is spaced outward from the outer end of the neck of the bottle to provide a fluid pathway from inside the bottle to the outside via the outlet aperture. The stopper may have a conical shape.

Therefore, a primary object of the invention is to provide a container which includes a simplified means for preventing spilling of the contents when initially pouring the contents into a receptacle.

Another object is to provide a container including simplified means for removing a partially filled container in an upside down position from a receptacle without spillage of any contents therein.

Another object of the invention is to provide a container including a cap and bottle, wherein the loosening of the cap enables fluid to be discharged from the container.

A primary feature of the invention is to provide a cap for positioning on the neck of a bottle wherein the loosening of the cap enables fluid to flow out from the bottle.

Another feature is to provide a cap including a locking crown having a conical stopper. The stopper extends inside the bottle when the cap closes the bottle; and the stopper is moved out partially or entirely from the bottle when the cap is opened.

Another feature is to provide a cap including a locking crown having an aperture therein, so that fluid may be discharged through the aperture when the cap is opened.

BRIEF DESCRIPTION OF THE DRAWINGS

Referring now to the drawings, in which the same characters of reference are employed to indicate corresponding similar aprts throughout the several figures of the drawings.

SPECIFICATION

Figure 1:
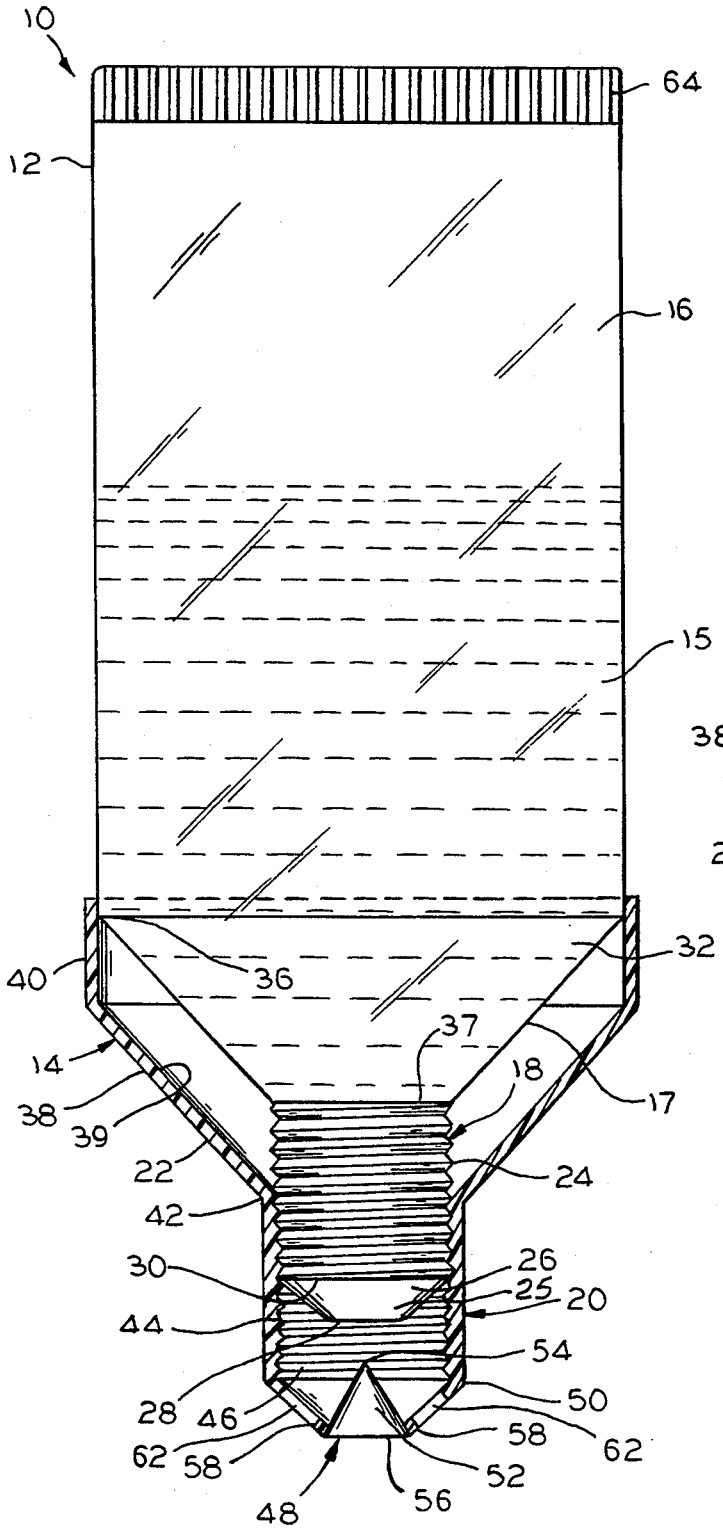
FIG. 1 is a front elevational view of the no spill container with the cap and neck of the container in section to show the open condition for the cap, and embodying the principles of the invention.
Figure 3:
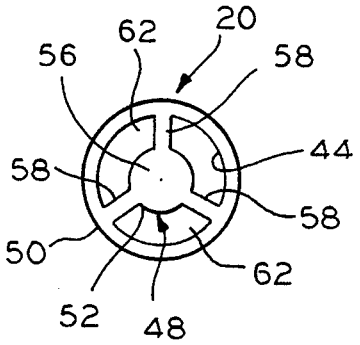
FIG. 3 is a top view of the locking crown.
Figure 2:
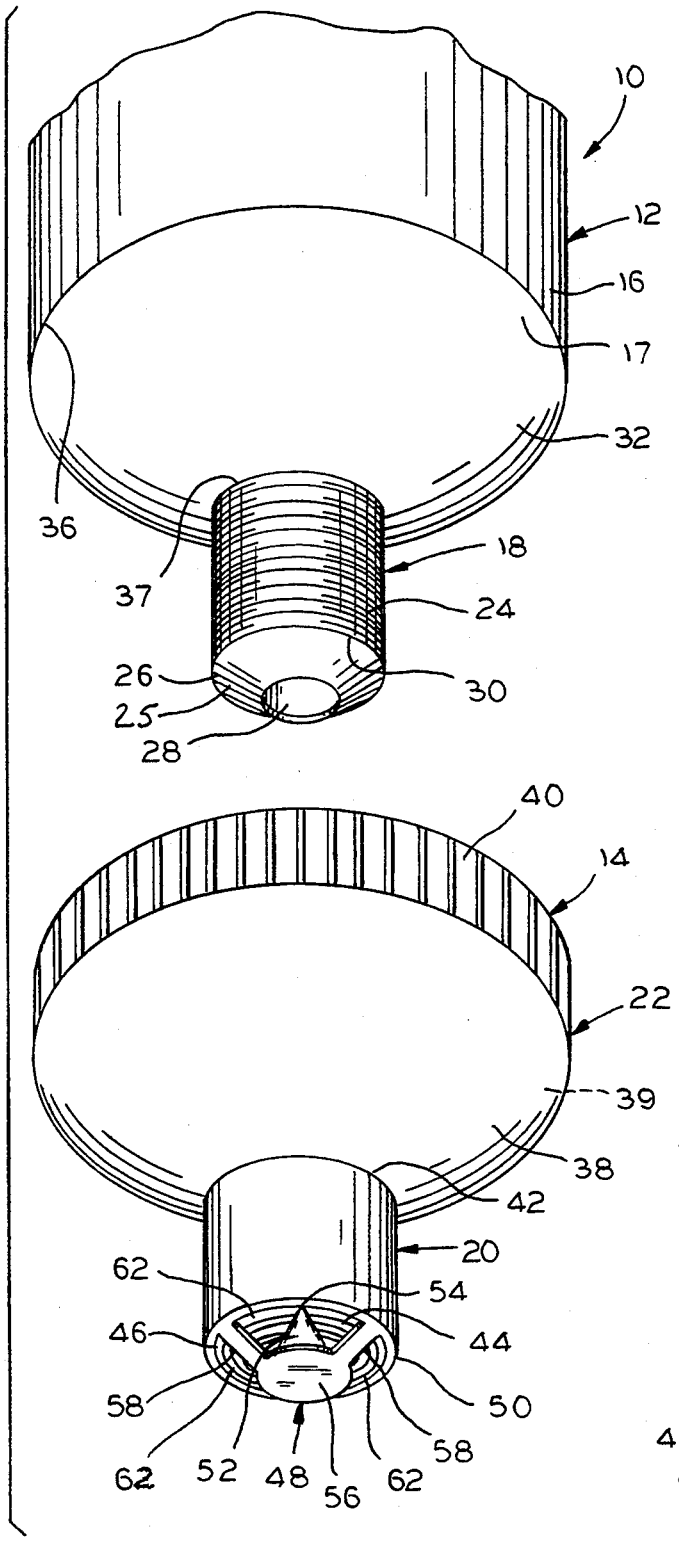
FIG. 2 is a perspective view of the cap spaced from the outer part of the bottle.

Referring now more specifically to FIGS. 1 and 2 of the drawings, the reference numeral 10 indicates generally a no spill container comprising a bottle 12 and a movable cap 14. The bottle 12 is used for storing fluids 15, and is particularly suitable for storing oils and lubricants used in motor vehicles. The bottle 12 includes a cylindrical body portion 16 having an outer shoulder 17 and a cylindrical hollow neck portion 18 extending outward from the shoulder 17. The cap 14 includes a cylindrical head portion 20 and a flared skirt 22 having substantially a conical or bowl shape.

The outside surface 24 of the neck 18 is threaded. The outer end 25 of the neck 18 has a convex outside curvature 26 and a central opening 28 formed therein. The outer end 25 of the neck 18 increases in circumference or cross sectional area from adjacent the opening 28 to adjacent the outer edge 30 of the threaded surface 24.

The shoulder 17 of the bottle 12 has substantially a conical shape. The outside surface 32 of the shoulder 17 has a convex curvature and decreases in circumference between the inner end 36 of the shoulder 17 to the inner end 37 of the neck 18. The skirt 22 of the cap 14 also has substantially a conical shape, and has a convex outside surface 38 and a concave inside surface 39.

An annular hem 40 is formed at the inner end of the skirt 22. The hem 40 may have a serrated or bumpy surface to afford ease of gripping. The skirt 22 decreases in circumference or cross sectional area from the hem 40 to the inner end 42 of the head 20. The skirt 22 overlays the shoulder 17.

The head 20 of the cap 14 has an internally threaded surface 44 defining a cavity 46 to receive the threaded neck 18.

A locking crown indicated generally by the reference numeral 48 is formed to the outer end 50 of the cylindrical head 20. The locking crown 48 includes a cone 52 having an apex 54 at the inner end and the widest or base part 56 at the outer end thereof. The apex 54 of the cone 52 extends inside the cavity 46 at the longitudinal center thereof.

Three spaced apart flanges 58 are attached or integrally formed at one end to the base 56 of the cone 52 and attached or integrally formed at the opposite end to the outer end 50 of the cylindrical wall of the head 20 to define three fluid discharge apertures 62. Each aperture 62 is bounded by two flanges 58, a portion of the outer end 50 of the head 20 and a part of the peripheral edge of the base 56 of the cone 52. The flanges 58 are inclined laterally outward from the base 56 of the cone 52 to the outer end 50 of the head 20.

The cap 14 is positioned over the neck 18 and the shoulder 17 of the bottle 12. The outside threaded neck surface 24 attaches to the internally threaded surface 44 of the head 20.

When the cap 14 closes the neck 18 of the bottle 12, the cone 52 extends inside the opening 28 and the base 56 of the cone 52 fully closes the opening 28, so that the cone 52 acts as a bottle stopper. The concave surface 39 of the skirt 22 of the cap 14 fits over the convex surface 32 of the shoulder 17, and the annular hem 40 extends around the upper end of the body 16 of the bottle 12.

The cap 14 may be opened by gripping the hem 40 of the cap 14 with one hand and twisting the bottom end 64 of the body portion 16 of the bottle 12 with the other hand to open the bottle 12. The bottom end 64 may Also have a serrated or bumpy surface for ease of gripping. When the bottle 12 is being opened, the neck 18 moves inward and away from the locking crown 48 along the threaded surface 44 of the head 20 of the cap 14. Now the fluid 15 inside the bottle 12 flows into the inside of the neck 18 and through the central opening 28 to pass into the cavity 46 in the head 20. The fluid then flows out from the cap 14 via the three apertures 62 in the locking crown 48.

Figure 4:
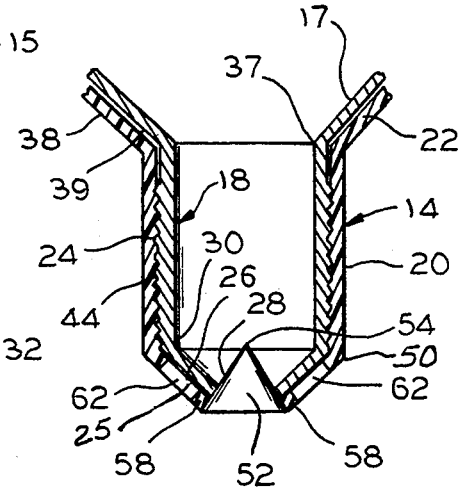
FIG. 4 is a side, sectional, and fragmentary view of the cap fitted over the neck of the bottle, to illustrate the closed condition for the container.

The neck 18 is movable along the head 20 of the cap 14, and, generally would not be detachable from the neck 18 of the bottle 12. When the cap 14 is secured on the neck 18 of the bottle 12 to close the bottle 12 ( FIG. 4 ), the cone 52 extends inside the opening 28 and the base 56 blocks the opening 28 at the outer end 25 of the neck 18; and the convex outside surface 26 of the neck 18 blocks and closes the discharge apertures 62. This prevents any outflow of fluid.

The cap 14 of the no spill container 10 may be positioned inside a fluid receiving opening such as an oil inlet in the automobile when the cap 14 is tightly positioned or closed on the neck 18 of the bottle 12. The bottle 12 extends outward from the fluid receiving opening. The cap 14 is then loosened, as aforedescribed by gripping the hem 40 of the cap and twisting the bottom end 64 of the bottle 12. Fluid inside the container 10 flows downward from the bottle 12 and out from the discharge apertures 62 in the locking crown 48.

Figure 6:
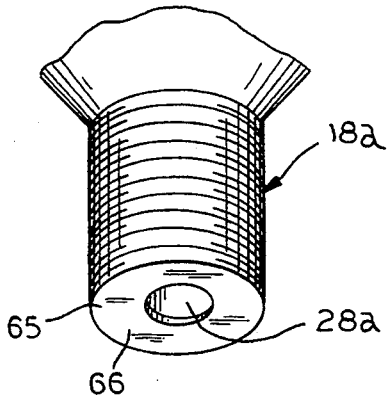
FIG. 6 is a perspective fragmentary view of the neck of the bottle for attaching to the cap in FIG. 5.
Figure 5:
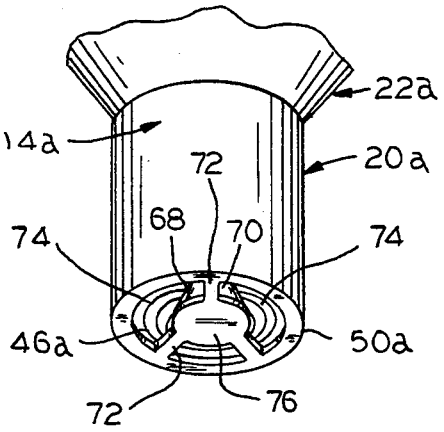
FIG. 5 is a perspective fragmentary view of another embodiment of the cap.
Figure 7:
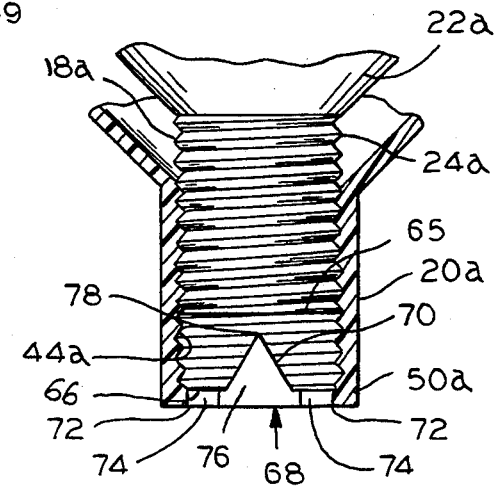
FIG. 7 is a sectional, fragmentary elevational view of the cap in FIG. 5 attached to the neck in FIG. 6, when the container is in the closed condition.

Referring now to FIGS. 5, 6, and 7, an alternate embodiment is illustrated, and similar parts may be identified by the same numeral and the suffix "a". The outer end 65 of the neck **18*a* has a flat surface 66 and includes a central opening 28*a* (FIG. 6**).

The head **20*a* of the cap 14*a* includes a locking crown 68 having a cone 70 centrally positioned and extending inside the cavity 46*a* of the head 20*a*. The cone 70 is connected to the outer end 50*a* of the head 20*a* by three spaced apart flat flanges 72. Apertures 74 are formed between two flanges 72, a portion of the outer end 50*a* of the head 20*a* and the base 76 of the cone 70. The apex end 78 of the cone 70 extends inside the cavity 46*a*. The base 76 is the outermost end of the cone 70 and closes the opening 28*a* at the outer end of the neck 18*a***.

When the container of the alternate embodiment is closed, the cone 70 of the locking crown 68 extends inside the opening **28*a*, so that the base 76 closes the opening 28*a* at the outer end 65 of the neck 18*a*. The flanges 72 of the head 20*a* abutt the flat surface 66 at the outer end 65 of the neck 18*a*; and the effect of this is to close the fluid discharge apertures 74. Thus, fluid flow is prevented by the stopper effect of the cone 70 extending inside the opening 28*a*, and the closing of the apertures 74 by the cooperation of the flanges 72 with the flat surface 66 at the outer end 65 of the neck 18*a***.

There are various modifications of the invention of a no spill container, the scope of which is limited solely and defined by the appended claims.

I claim:

1. A container device for storing fluid comprising:

a bottle having a hollow body portion communicating with a hollow neck portion, the outer end of the neck portion having an opening formed therein;

a cap for movably attaching to the neck portion and having a closure means for extending through said opening in the neck, said closure means having an open-position to permit fluid flow out from the bottle and a closed-position to prevent such flow;

the outer end of the neck including inclined sidewalls flaring angularly outward toward the body of the bottle whereby the cross-sectional area of the outer end of the neck incrementally increases; and the outer end of the cap including an inclined surface having at least one aperture formed therein, said inclined surface also flaring angularly outward complementary with said side walls of the neck, so that when said closure means is in said closed-position said aperture is substantially closed, and when said closure means is in the open-position said aperture is open to permit said fluid flow.

2. The container of claim 1, wherein said closure means is substantially a cone configuration having an apex end and a base end, said apex end being the inner end of the cone and positioned inside said neck and said base being the outer end of the cone for closing said opening when the cap is in the closed-position, said inclined surface extending inward from said base the cone toward the body of the container.

3. The container of claim 2, wherein:

said inclined surface includes at least two inclined flanges complementary with said side walls of the neck, said aperture being defined between said two flanges, said flanges of the cap being positioned over and substantially in contact with the side walls of the neck to close said aperture when the cap is in the closed-position.

4. The container of claim 1, wherein:

said neck includes a threaded surface; and said cap includes a head section and a skirt, said head section having a threaded surface for threadedly attaching with the threaded surface of the neck, said skirt extending inward and over the bottle, the inner end of the skirt providing a gripping surface away from the head of the cap for applying an external force when switching the cap from an open-position to a closed-position and visa versa.

5. The container of claim 4, wherein:

one of said threaded surfaces moving along said other threaded surface when switching said cap from one of said positions to the other of said positions.

6. A container device for storing fluid comprising:

a bottle having a hollow body portion in communication with a hollow neck portion, the outer end of the neck portion having an opening formed therein, said neck portion having a threaded surface; and a cap including a head portion and a skirt, said head portion having a closure means for extending through said opening in the neck, said closure means having an open-position to permit fluid flow out from the bottle and a closed-position to prevent such flow, said head portion including a threaded surface for threadedly attaching with the threaded surface of the neck, said skirt extending inward and over the bottle, the inner end of the skirt providing a gripping surface away from the head of the cap for applying an external force when switching the cap from said open-position to said closed-position and visa versa to cause the threaded surface of one of said portions to move along the threaded surface of the other said portion.

* * * * *